US006659202B2

(12) United States Patent
Runquist et al.

(10) Patent No.: US 6,659,202 B2
(45) Date of Patent: Dec. 9, 2003

(54) STEERABLE FLUID HAMMER

(75) Inventors: Randy Runquist, Oskaloosa, IA (US); Mark Van Houwelingen, Knoxville, IA (US)

(73) Assignee: Vermeer Manufacturing Company, Pella, IA (US)

( * ) Notice: Subject to any disclaimer, the term of this patent is extended or adjusted under 35 U.S.C. 154(b) by 0 days.

(21) Appl. No.: 09/918,373

(22) Filed: Jul. 30, 2001

(65) Prior Publication Data

US 2002/0084109 A1 Jul. 4, 2002

Related U.S. Application Data

(60) Provisional application No. 60/221,749, filed on Jul. 31, 2000.

(51) Int. Cl.[7] ..... E21B 7/08; E21B 4/14; E21B 4/02; E21B 10/36

(52) U.S. Cl. ..... 175/61; 175/107; 175/296; 175/305

(58) Field of Search ..... 175/61, 62, 107, 175/293, 296, 300, 305

(56) References Cited

U.S. PATENT DOCUMENTS

| | | | | | |
|---|---|---|---|---|---|
| 3,568,783 | A | * | 3/1971 | Chenoweth et al. | 175/296 |
| 4,612,987 | A | | 9/1986 | Cheek | |
| 4,632,191 | A | * | 12/1986 | McDonald et al. | 173/91 |
| 4,694,911 | A | | 9/1987 | Kennedy | |
| 4,699,223 | A | * | 10/1987 | Noren | 175/40 |
| 4,705,118 | A | * | 11/1987 | Ennis | 175/296 |
| 4,819,746 | A | * | 4/1989 | Brown et al. | 175/215 |
| 4,852,669 | A | * | 8/1989 | Walker | 175/107 |
| 4,921,056 | A | * | 5/1990 | Ennis | 173/136 |
| 5,014,796 | A | | 5/1991 | Gustafsson | |
| 5,078,218 | A | * | 1/1992 | Smet | 175/107 |
| 5,107,944 | A | | 4/1992 | Gustafsson | |
| 5,305,837 | A | * | 4/1994 | Johns et al. | 175/296 |
| 5,396,965 | A | | 3/1995 | Hall et al. | |
| 5,497,839 | A | * | 3/1996 | Moir | 175/215 |
| 5,520,256 | A | | 5/1996 | Eddison | |
| 5,542,482 | A | | 8/1996 | Eddison | |
| 5,662,180 | A | * | 9/1997 | Coffman et al. | 173/112 |
| 5,679,894 | A | | 10/1997 | Kruger et al. | |
| 5,682,956 | A | | 11/1997 | Deken et al. | |
| 5,715,897 | A | | 2/1998 | Gustafsson | |
| 5,727,641 | A | | 3/1998 | Eddison et al. | |
| 5,738,178 | A | | 4/1998 | Williams et al. | |
| 5,803,188 | A | * | 9/1998 | McInnes | 173/126 |
| RE36,166 | E | * | 3/1999 | Johns et al. | 173/17 |
| 6,047,784 | A | | 4/2000 | Dorel | |
| 6,050,350 | A | | 4/2000 | Morris et al. | |
| 6,155,361 | A | * | 12/2000 | Patterson | 173/13 |
| 6,206,108 | B1 | * | 3/2001 | MacDonald et al. | 175/24 |
| 6,367,565 | B1 | * | 4/2002 | Hall | 175/296 |
| 6,386,301 | B1 | * | 5/2002 | Rear | 175/296 |

OTHER PUBLICATIONS

Exhibit A, "Integrated Drilling System," *Novatek*, 1 page, printed from website Dec. 16, 2002 (Published Date Unknown).

(List continued on next page.)

*Primary Examiner*—David Bagnell
*Assistant Examiner*—Jennifer H Gay
(74) *Attorney, Agent, or Firm*—Merchant & Gould P.C.

(57) ABSTRACT

An apparatus and method for directional drilling utilizing a fluid hammer. The fluid hammer is coupled to a bent steering member which, in turn, is coupled to a drill string. The bent steering member includes means for rotating the fluid hammer independently of the bent steering member. The means for rotating may be a mud motor or a dual drive, pipe-in-pipe mechanism. The fluid hammer may be directed by rotating the drill string and bent steering member to point the fluid hammer in a desired direction. The bent steering member may include a sonde for monitoring its orientation. Fluid pressure capable of activating the fluid hammer is conveyed to the fluid hammer by means of the drill string.

9 Claims, 1 Drawing Sheet

OTHER PUBLICATIONS

Exhibit B, "Down–Hole Mud–Actuated Hammer," *Novatek*, 2 pages, printed from website Dec. 16, 2002 (Published Date Unknown).

Exhibit C, "Down–Hole Mud–Actuated Hammer," Status Report, *Novatek*, 2 pages (Date Unknown).

Exhibit D, "Development And Testing of a Down–Hole Mud Actuated Hammer," Phase II Final Report, *Novatek*, 15 pages (May 1999).

Pixton, D., and D. Hall, "A New Generation Mud Hammer Drilling Tool," Annual Report for project DE–FG03–95ER82042 (Mar. 1997).

Walker, B.H. et al., "Roller–Bit Penetration Rate Response as a Function of Rock Properties and Well Depth," in Proceedings of the 61st Annual Technical Conference and Exhibition of the Society of Petroleum Engineers, SPE 15620, New Orleans (Oct. 5–8, 1986).

Pixton, D.S., and D.R. Hall, "A Rotary–Percussive Drilling Engine," in Proceedings of the 1998 ASME Energy Sources Technology Conference, Houston (Feb. 2–4, 1998).

Pierce, K. et al., "Advanced Drilling Systems Study," Technical Report SAND95–0331, Sandia National Laboratories, Albuquerque, NM (May 1996).

* cited by examiner

STEERABLE FLUID HAMMER

CROSS-REFERENCE TO RELATED APPLICATIONS

This application claims the benefit of U.S. Provisional Application 60/221,749 filed on Jul. 31, 2000.

FIELD OF THE INVENTION

The present invention relates generally to underground drilling machines. More particularly, the present invention relates to a steerable fluid hammer apparatus for use in directional drilling.

BACKGROUND OF THE INVENTION

Utility lines for water, electricity, gas, telephone, and cable television are often run underground for reasons of safety and aesthetics. Sometimes, the underground utilities can be buried in a trench that is subsequently back filled. However, trenching can be time consuming and can cause substantial damage to existing structures or roadways. Consequently, alternative techniques such as horizontal directional drilling (HDD) are becoming increasingly more popular.

A typical horizontal directional drilling machine includes a frame on which is mounted a drive mechanism that can be slidably moved along the longitudinal axis of the frame. The drive mechanism is adapted to rotate a drill string about its longitudinal axis. The drill string comprises a series of drill pipes threaded together. Sliding movement of the drive mechanism along the frame, in concert with the rotation of the drill string, causes the drill string to be longitudinally advanced into or withdrawn from the ground.

In a typical rotational directional drilling sequence, the horizontal directional drilling machine drills a hole into the ground at an oblique angle with respect to the ground surface. By rotating the drill string and drill head, dirt and stone is ground and cut into pieces. The cutting mechanism is the action of the drill bit being rotated and pushed against the rock and soil. To remove cuttings and dirt during drilling, drilling fluid can be pumped by a pump system through the drill string, over a drill head (e.g., a cutting or boring tool such as a drill bit) at the end of the drill string, and back up through the hole. After the drill head reaches a desired depth, the drill head is then directed along a substantially horizontal path to create a horizontal hole. Once the desired length of hole has been drilled, the drill head is then directed upwards to break through the ground surface, completing a pilot bore or bore-hole.

As an alternative to rotational drilling, impact cutting is employed to cut through especially hard substances like stone. Impact cutting involves the use of fluid pressure such as air or liquids to operate a fluid hammer. A fluid hammer includes a piston hammer which when activated by fluid pressure impacts repeatedly against the drill bit or a drill bit anvil, causing the cutting mechanism of the assembly to be a chipping or picking action rather than a grinding action. The drill bit used in impact drilling with a fluid hammer typically includes protrusions that function to reduce the effective surface area of the drill bit in contact with the rock.

In order to steer the apparatus during impact cutting, typically the drill bit is made unbalanced such that when not rotated it tends to deviate from a straight path and cuts in an arc. When drilling a curved bore the drill bit preferably is rocked so that the unbalanced protrusions on the drill bit eventually strike different portions of the rock face being drilled, gradually cutting an arced full bore. When a straight bore-hole is desired the drill bit is continuously rotated to prevent deviation from a straight path. Although effective, oscillating and rocking the drill string is a complicated, inefficient control technique. Furthermore, this method requires a more complex drill bit.

SUMMARY OF THE INVENTION

The present invention involves the use of a rotation means to rotate the fluid hammer and drill bit while the apparatus is being steered away from a straight path. By including in the drilling apparatus a means of rotation that may operate independently from the rotation of the drill string, a bent steering member may be held stationary by the drill string in order to steer the apparatus, while at the same time the fluid hammer and drill bit may be continuously rotated. Such an apparatus eliminates the need for complex drill bits. In addition, the method of operating and steering the apparatus is simplified by eliminating the need to rock the drill string.

One aspect of the present invention relates to a steerable directional drilling apparatus that includes a fluid hammer for impact cutting which is coupled to a bent steering member having a mud motor disposed therein. The mud motor is coupled to the fluid hammer such that the fluid hammer may be rotated even when the bent steering member is held stationary by a drill string. Thus, a balanced drill bit may be used with the fluid hammer which may be continuously rotated even when deviating from a straight path.

Another aspect of the present invention is directed towards a method for operating and steering a fluid hammer while drilling a bore-hole by coupling the fluid hammer to a bent steering member including a mud motor. In order to cut a straight bore-hole, pressurized fluid is supplied to activate the fluid hammer and the mud motor while the drill string is continuously rotated and advanced with limited force. The actual speed of rotation of the drill bit is the sum of the mud motor rotation and the drill string rotation. To deviate from a straight path, pressurized fluid is still supplied to activate the fluid hammer and the mud motor, but the drill string is held stationary to allow the bent steering member to force the apparatus to deviate. During deviation from a straight path, the fluid hammer and drill bit are rotated only at the speed supplied by the mud motor.

Another aspect of the present invention is directed towards a method for operating and steering a fluid hammer while drilling a bore-hole by coupling the fluid hammer to a pipe-in-pipe bent steering member including an inner pipe member and an outer pipe member. The inner pipe member can be rotated independently from the outer pipe member. The outer pipe member of the bent steering member may be positioned and held stationary by means of the outer pipe members of the drill string while the inner pipe member is rotated A variety of advantages of the invention will be set forth in part in the description that follows, and in part will be apparent from the description, or may be learned by practicing the invention. It is to be understood that both the foregoing general description and the following detailed description are explanatory only and are not restrictive of the invention as claimed.

DETAILED DESCRIPTION OF THE PREFERRED EMBODIMENT

With reference now to the drawings, a description of various exemplary aspects of the present invention will now be provided.

Figure 1:
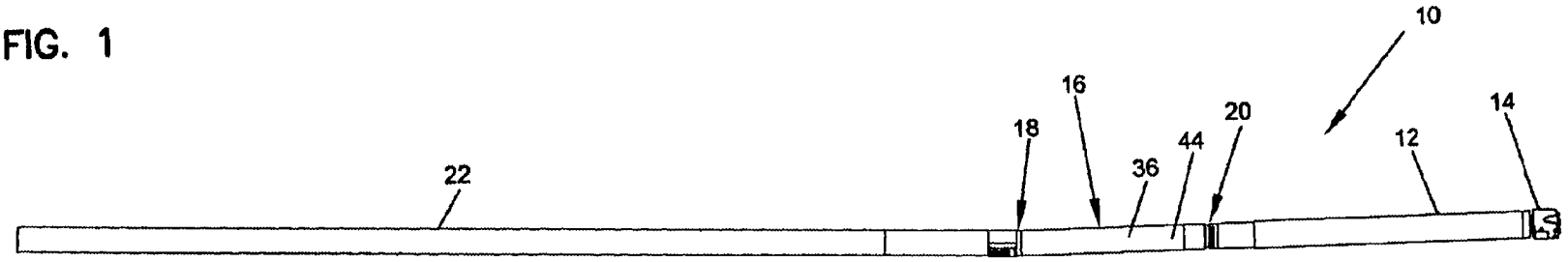
FIG. 1 is an embodiment of a steerable drilling apparatus according to the according to the present invention having a fluid hammer and mud motor.

Referring now to FIG. 1 which illustrates a drilling apparatus 10 in accordance with the present invention. The apparatus includes a drill bit 14 coupled to a fluid hammer 12. The fluid hammer 12 is coupled to a bent steering member 16. The bent steering member 16 is bent at point 18. The bent steering member includes a mud motor 36 which is coupled to the fluid hammer 12 near point 20. The bent steering member 16 is coupled to a drill string 22. The drill string 22 couples the drilling apparatus 10 to a directional drilling machine at the ground's surface.

Figure 2:
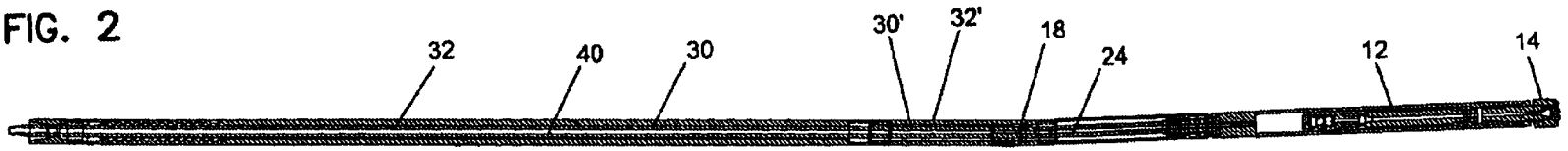
FIG. 2 is an embodiment of a steerable drilling apparatus according to the present invention having a fluid hammer and incorporating a pipe-in-pipe mechanism.
Figure 3:
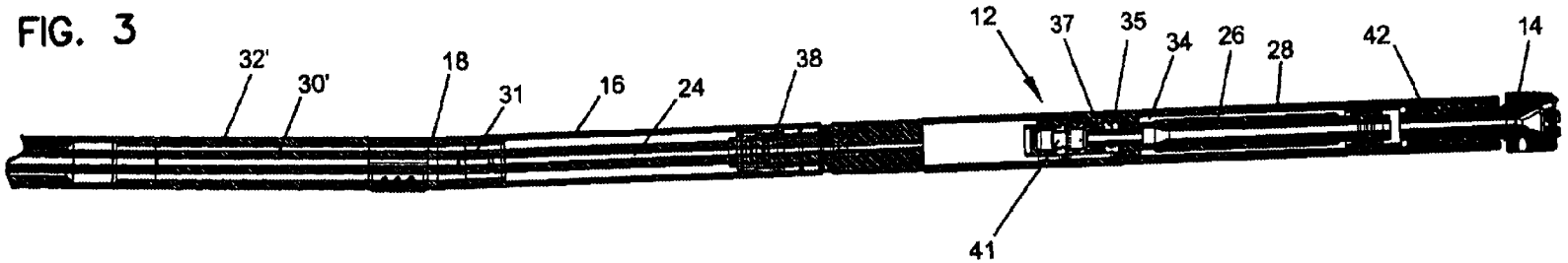
FIG. 3 is an enlarged view of the steerable drilling apparatus shown in FIG. 2.

FIGS. 2 and 3 include a more detailed depiction of a fluid hammer 12. The fluid hammer 12 includes a hammer housing 28 which defines a lower piston chamber 34. A valve housing 37 defines an upper piston chamber 35 and houses a spool valve 41. A piston hammer 26 is slidably disposed in and separates the upper piston chamber 35 from the lower piston chamber 34. As is known in the art, by way of spool valve 41 the upper piston chamber 35 is cyclically pressurized and depressurized to generate the forward and return stroke of the piston hammer 26. The forward or work stroke of the piston hammer 26 impacts a target such as a drill bit 14 or drill bit anvil 42. The return or rearward stroke of the piston hammer 26 is caused by depressurization of the upper piston chamber 35, allowing the lower piston chamber 34, that is preferably continuously pressurized, to generate the return stroke of the piston hammer 26. Therefore, by application of fluid pressure to the piston chambers 34 and 35, the piston hammer 26 reciprocates inside the piston chamber 34 repeatedly striking a drill bit anvil 42 and driving the drill bit 14 against the dirt and stone to be drilled. A mud hammer, which is a fluid hammer operated by liquid pressure, typically operates at liquid pressures ranging from 1000 to 3000 psi, typically around 2000 psi. A pneumatic hammer, which is a fluid hammer operated by gas pressure, typically operates at pressures ranging from 100 to 500 psi, often around 200 psi.

The present invention couples a fluid hammer 12, such as the one described above, to a means of rotation that may rotate independently of the drill string rotation. FIG. 1 illustrates a drilling device wherein the independent means of rotation is a mud motor 36, and FIGS. 2 and 3 illustrate an alternative embodiment of the drilling device wherein the independent means of rotation is a dual pipe drive mechanism as described below.

Mud motors, like fluid hammers, are powered by fluid pressure. A mud motor typically includes a rotating member that is powered with the drilling mud as it flows through an elongated body. Fluid-powered motors have been in use in drilling assemblies in the past. There are many different designs of mud motors, many of which include a fixed stator rotating rotor powered by fluid flow based on the original principles developed by Moineau. Mud motor 36, for example may comprise a fluid-driven positive displacement (Moineau or vane-type) motor.

The mud motor 36 is coupled to the fluid hammer 12 so that when the mud motor 36 operates it rotates the fluid hammer 12. The fluid pressure necessary to operate a mud motor typically falls within the range of 550 psi to 1100 psi. Therefore, if sufficient fluid pressure is to be available to motivate the fluid hammer 12 after the mud motor 36 is motivated, the total fluid pressure conveyed by the drill string 22 is preferably on the order of 2500 to 3100 psi.

By combining a fluid hammer 12 with a bent steering member 16 having a mud motor 36 disposed therein, the drill bit 14 may be continuously rotated even while the bent steering member 16 is held stationary via the drill string 22 during steering. The orientation of the bent steering member 16 and the fluid hammer 12 may be directed toward any desired path by rotating the drill string 22 to the desired position. The drill string 12 may then be held in position which, by means of the bent steering member 16, will force the fluid hammer 12 and drill bit 14 to cut away from a straight path. Concurrently, however, the mud motor 36 may operate to rotate the fluid hammer 12 and drill bit 14. When a straight path is desired, the drill string 22 may be continuously rotated to prevent the bent steering member 16 from directing the drilling apparatus 10 away from a straight path.

Other means may also be used to rotate the fluid hammer 12 while holding the bent steering member 16 stationary. In the alternative embodiment shown in FIGS. 2 and 3, a pipe-in-pipe design is employed to rotate the fluid hammer 12 independently from the bent steering member 16. As is known in the art, a pipe-in-pipe drill string includes inner pipe members 30 disposed within outer pipe members 32. The drill string, therefore, is comprised of a series of drill pipes, each drill pipe including two coaxial pipe members. The inner pipe members 30 of adjacent drill pipes are coupled, and the outer pipe members 32 of adjacent drill pipes are coupled. The inner pipe members 30 are coupled to an inner pipe drive mechanism at the ground surface, and the outer pipe members 32 are coupled to an outer pipe member drive mechanism also at the ground's surface. The inner pipe members 30 of the drill string can be rotated independently from the outer pipe members 32. Thus, the pipe-in-pipe drill string is sometimes referred to as a dual drive drill string.

In the embodiment shown in FIGS. 2 and 3 the bent steering member 16 includes an outer housing 32' and an inner pipe 30'. The inner pipe 30' is coupled to the inner pipe members 30 of a pipe-in-pipe drill string. The outer housing 32' is coupled to the outer pipe members 32 of a pipe-in-pipe drill string. Near point 18 where the outer housing 32' is bent, the inner pipe 30' is interrupted by a universal joint 31 which allows the inner pipe 30' to rotate despite its change in direction. The inner pipe 30' is coupled to the fluid hammer 12 near point 38. Using the dual drive drill string, the fluid hammer 12 may be rotated via the inner pipe members and the inner pipe member drive mechanism while the bent steering member 16 is held stationary via the outer pipe members and the outer pipe drive mechanism.

Both embodiments of the present system shown in the figures convey fluid pressure from the ground surface to the fluid hammer 12. Therefore, the drill string 22 typically defines an interior chamber 40 in order to supply fluid pressure to the bent steering member 16. Pressurized drilling fluid may perform several functions including carrying away dirt and cuttings from the bore-hole as well as powering drilling components near the drilling end of the drill string. For example, in FIG. 1, the fluid pressure from the drill string 22 powers both a mud motor 36 and a fluid hammer 12. In FIG. 3 the fluid pressure conveyed in the interior chamber 40 motivates the fluid hammer 12 but no mud motor. Therefore, the fluid pressure necessary to operate a pipe-in-pipe system as described above is much less than that necessary when a mud motor is used. The bent steering member 16 includes an internal conduit 24 which is in fluid communication with both the interior chamber 40 of the drill string 22 and the piston chamber 34 of the fluid hammer 12. The internal conduit 24 conveys fluid pressure from the drill string 22 to the fluid hammer 12.

The present invention may be applied as a method for steering a directional drilling apparatus and has been found to be superior to methods using grinding tricone drill bits. The preferred cutting action for cutting through rock formations is the impact breaking supplied by a fluid hammer which efficiently breaks up localized areas of the rock. A fluid hammer achieves this result with little or no grinding effect. By combining an independent rotation means with a fluid hammer, the present invention combines both the efficient cutting action of the fluid hammer 12 and the efficient steerability of a bent steering member 16 into one drilling apparatus 10 utilizing a balanced drill bit.

A sonde 44 may also be included in the bent steering member 16 in order to monitor the position and orientation of the apparatus. A sonde transmits electronic positioning signals to a worker typically by way of a hand-held complementary receiving device. Based on this positioning information, a user is able to monitor the orientation of the fluid hammer 12 and drill bit 14, thereby improving steering accuracy.

The above specification provides a description of the present invention. Since many embodiments of the invention can be made without departing from the spirit and scope of the invention, the invention resides in the claims hereinafter appended.

We claim:

1. A steerable directional drilling device for drilling a bore-hole, the device comprising:

a drill bit;

a fluid hammer coupled to the drill bit, the fluid hammer having:

a hammer housing;

a piston hammer disposed in the hammer housing, the piston hammer capable of reciprocating movement inside the hammer housing when driven by liquid fluid pressure;

a bent steering member coupled to the fluid hammer, the bent steering member including an interior conduit to convey fluid pressure from a drill string to the fluid hammer;

a mud motor coupled to the fluid hammer and disposed within the bent steering member, the mud motor rotating the fluid hammer when activated by liquid fluid pressure delivered through the drill string; and an orientation device disposed adjacent to the bent steering member, the orientation device configured to determine the angular orientation of the drill bit and transmit a signal corresponding to the angular orientation of the drill bit.

2. The steerable directional drilling device of claim 1 wherein the drill bit is a balanced drill bit.

3. The steerable directional drilling device of claim 1 wherein the orientation device includes a sonde disposed adjacent to the bent steering member.

4. The steerable directional drilling device of claim 1 wherein the orientation device includes a sonde disposed adjacent to the bent steering member, and wherein the drill bit is a balanced drill bit.

5. A steerable directional drilling device for drilling a bore-hole, the device comprising:

a drill bit;

a fluid hammer coupled to the drill bit, the fluid hammer having:

a hammer housing;

a piston hammer disposed in the hammer housing, the piston hammer capable of reciprocating movement inside the hammer housing when driven by liquid fluid pressure;

a bent steering member including an inner pipe and an outer housing, the inner pipe being coupled to the fluid hammer, the outer housing and inner pipe being capable of independent rotation, the bent steering member including an interior conduit to convey liquid fluid pressure from a drill string to a piston chamber of the fluid hammer.

6. The steerable directional drilling device of claim 5 wherein the inner pipe is configured to be coupled to an inner pipe member of a pipe-in-pipe drill string and the outer housing is configured to be coupled to an outer pipe member of a pipe-in-pipe drill string.

7. A method for directional drilling with a fluid hammer, the method including the steps of:

providing a fluid hammer coupled to a drill bit;

providing a mud motor find a sonde disposed within a bent steering member, the bent steering member being coupled to a drill string and the fluid hammer;

providing a sonde disposed adjacent to the bent steering member;

monitoring signals generated by the sonde and determining the angular orientation of the fluid hammer and drill bit;

rotating the bent steering member to a position and aligning the fluid hammer and drill bit in a desired direction;

holding the bent steering member in position while pumping fluid to the fluid hammer to operate the fluid hammer;

holding the bent steering member in position while pumping fluid to the mud motor to rotate the fluid hammer and drill bit; and advancing the fluid hammer longitudinally.

8. The method of claim 7, wherein:

holding the bent steering member in position while pumping fluid to the fluid hammer includes pumping liquid fluid to the fluid hammer to operate the fluid hammer.

9. A method for directional drilling with a fluid hammer, the method including the steps of:

providing a fluid hammer coupled to a drill bit, the fluid hammer also being coupled to an inner pipe of a bent steering member, the bent steering member including an outer housing, the inner pipe being capable of rotation independent of the outer housing;

rotating the outer housing of the bent steering member to a position aligning the fluid hammer and drill bit in a desired direction;

holding the outer housing of the bent steering member in position while pumping liquid to a piston chamber of the fluid hammer to operate the fluid hammer;

while holding the outer housing of the bent steering member in position, rotating the fluid hammer and drill bit by means of the inner pipe independently of the outer housing;

advancing the fluid hammer longitudinally.

* * * * *